US007655181B2

(12) United States Patent
Shima et al.

(10) Patent No.: US 7,655,181 B2
(45) Date of Patent: Feb. 2, 2010

(54) SCREW CONVEYOR OF ROTARY HEARTH FURNACE FOR DISCHARGING REDUCED IRON

(75) Inventors: Shinji Shima, Fukuoka (JP); Toshitaka Nakayama, Fukuoka (JP); Masahide Nagatomi, Fukuoka (JP)

(73) Assignees: Nippon Steel Engineering Co., Ltd., Fukuoka (JP); Nittetsu Plant Designing Corporation, Fukuoka (JP)

( * ) Notice: Subject to any disclaimer, the term of this patent is extended or adjusted under 35 U.S.C. 154(b) by 0 days.

(21) Appl. No.: 12/225,919

(22) PCT Filed: Apr. 3, 2007

(86) PCT No.: PCT/JP2007/057442

§ 371 (c)(1),
(2), (4) Date: Oct. 2, 2008

(87) PCT Pub. No.: WO2007/116878

PCT Pub. Date: Oct. 18, 2007

(65) Prior Publication Data

US 2009/0045558 A1 Feb. 19, 2009

(30) Foreign Application Priority Data

Apr. 6, 2006 (JP) ..... 2006-105651

(51) Int. Cl.
*C21B 13/10* (2006.01)

(52) U.S. Cl. ..... 266/177; 266/176

(58) Field of Classification Search ..... 266/176, 266/177

See application file for complete search history.

(56) References Cited

U.S. PATENT DOCUMENTS

| | | | | |
|---|---|---|---|---|
| 3,443,931 | A | 5/1969 | Beggs et al. | |
| 4,636,127 | A * | 1/1987 | Olano et al. | 414/158 |
| 6,182,817 | B1 * | 2/2001 | Rinker et al. | 198/671 |
| 2003/0075842 | A1 | 4/2003 | Urabe et al. | |
| 2003/0201585 | A1 | 10/2003 | Urabe et al. | |

FOREIGN PATENT DOCUMENTS

| | | |
|---|---|---|
| JP | 45-19569 | 7/1970 |
| JP | 3-20482 | 1/1991 |
| JP | 2001-304766 | 10/2001 |
| JP | 2005-61651 | 3/2005 |
| WO | 03/036211 | 5/2003 |

OTHER PUBLICATIONS

International Search Report issued Jul. 10, 2007 in the International (PCT) Application of which the present application is the U.S. National Stage.

International Preliminary Report on Patentability issued Nov. 27, 2008 in International Application No. PCT/JP 2007/057442.

* cited by examiner

*Primary Examiner*—Scott Kastler
(74) *Attorney, Agent, or Firm*—Wenderoth, Lind & Ponack, L.L.P.

(57) ABSTRACT

A reduced iron discharging screw conveyer is provided in a rotary hearth furnace and discharges reduced iron out of the rotary hearth furnace. The rotary hearth furnace produces the reduced iron by charging and heating a pellet including metallic oxide and coal material onto a rotary hearth rotating in a horizontal plane. The reduced iron discharging screw conveyer has a rotary shaft and a screw blade which is spirally formed on an outer surface of the rotary shaft. A lead angle θ of the screw blade 5*a* satisfies a condition of "0.46 rad≦θ≦0.79 rad". A ratio (h/D) between height h of the screw blade and an outer diameter D of the screw conveyer is smaller than 0.2, and a ratio (t/h) between thickness t and height h of the screw blade is larger than or equal to 0.12.

6 Claims, 3 Drawing Sheets

SCREW CONVEYOR OF ROTARY HEARTH FURNACE FOR DISCHARGING REDUCED IRON

TECHNICAL FIELD

The present invention relates to a reduced iron discharging screw conveyer for discharging a reduced iron out of a furnace, which is provided in a rotary hearth furnace.

BACKGROUND ART

A rotary hearth furnace is used for producing reduced iron. In the rotary hearth furnace, a pellet is prepared using coal material and metallic oxide such as iron ore and iron making dust. The reduced iron is produced by charging and heating (reducing) the pellet onto the rotary hearth which rotates in a horizontal plane in the rotary hearth furnace (refer to patent documents 1, 2, 3).

FIG. 5 is a schematic diagram showing an example of a rotary hearth furnace. In FIG. 5, reduced iron is produced by charging a pellet on a rotary hearth 21 through a pellet charge opening 22 and heating (reducing) the pellet. The rotary hearth 21 rotates in the horizontal plane in a rotary hearth furnace 20. The reduced iron is moved toward the circumference of the rotary hearth 21 by a screw conveyer 23 and then discharged out of the furnace through a discharge opening 24. The screw conveyer generally has a water-cooled structure provided in a rotary shaft. A screw blade is made of material having heat resistance and abrasion resistance.

On the other hand, there is a technique for reducing attrition of a screw blade, which reduces an apparent weight of the screw conveyer using an elevating cylinder to set a pressing force applied to a rotary hearth within a predetermined range (larger than or equal to 4000 N/m and smaller than or equal to 20000 N/m) (refer to Patent Document 4).

[Patent Document 1] Japanese Patent Publication No. 45-19569

[Patent Document 2] Japanese Patent No. 3020482

[Patent Document 3] U.S. Pat. No. 4,636,127

[Patent Document 4] Japanese Patent Publication No. 2005-61651

In the rotary hearth furnace described above, the screw blade is used at high temperature. In addition, the screw blade constantly receives frictional force since the screw blade contacts a surface of the rotary hearth when scraping out the reduced iron lying on the rotary hearth. Therefore, in the conventional structure, the screw blade is worn for a short period due to the attrition and can not be continuously used for a long period. In this case, it is necessary to often bring out the screw conveyer from the rotary hearth furnace and check the screw conveyer. Thus an operation rate of the rotary hearth furnace is reduced.

In an apparatus disclosed in Patent Document 4, the pressing force of the screw conveyer applied to the rotary hearth is set within the predetermined range to reduce the attrition of the screw blade.

However, in the apparatus disclosed in Patent Document 4, it is necessary to adjust the force of the elevating cylinder for pushing up the screw conveyer so that the pressing force of the screw conveyer falls within the predetermined range. When the force for pushing up the screw conveyer is wrongly adjusted, the apparent weight of the screw conveyer may be excessively reduced. In addition, if the force of the elevating cylinder for pushing up the screw conveyer is reduced using a spring and soon, the number of components is increased and the apparatus increases in cost.

SUMMARY OF THE INVENTION

The present invention is to provide a reduced iron discharging screw conveyer of a rotary hearth furnace, which can reduce maintenance frequency of the screw conveyer and improve an operation rate of the rotary hearth furnace in a simple structure by extending a life span of a screw blade of the reduced iron discharging screw conveyer provided in the rotary hearth furnace.

The present invention provides a reduced iron discharging screw conveyer which is provided in a rotary hearth furnace and discharges reduced iron out of the rotary hearth furnace. The rotary hearth furnace produces the reduced iron by charging a pellet including raw material and coal material onto a rotary hearth which rotates in a horizontal plane and heating (reducing) the pellet. The screw conveyer has a rotary shaft and a screw blade formed spirally on an outer surface of the rotary shaft. The lead angle θ (rad) of the screw blade satisfies the following condition of expression (1).

$$0.46\text{rad} \leqq \theta \leqq 0.79\text{rad} \quad (1)$$

The ratio (h/D) between the height (h) of the screw blade and the outer diameter (D) of the screw conveyer may be smaller than 0.2, and the ratio (t/h) between the thickness (t) of the screw blade and the height (h) of the screw blade may be larger than or equal to 0.12. In addition, the screw blade may be fixed to the rotary shaft via weld. The end of the screw blade contacts the rotary hearth.

According to the reduced iron discharging screw conveyer of the present invention, by setting the lead angle of the screw blade so as to satisfy the above condition of expression (1), it is possible to reduce the friction force between the screw blade and the rotary hearth. In addition, when a water-cooled structure is provide in the rotary shaft, by setting the ratio (h/D) between the height of the screw blade and the outer diameter of the screw conveyer so as to be smaller than 0.2 and setting the ratio between the thickness and the height of the screw blade so as to be larger than or equal to 0.12, it is possible to improve the water-cooled effect applied to the screw blade from the rotary shaft and reduce the friction amount of the screw blade. In addition, by forming the screw blade on the rotary shaft via weld, the screw conveyer satisfying the above condition is easily manufactured. When the life span of the screw blade can be extended, it is possible to improve the operation rate of the rotary hearth furnace and reduce the equipment expenses per production volume.

DETAILED DESCRIPTION OF THE INVENTION

Figure 1:
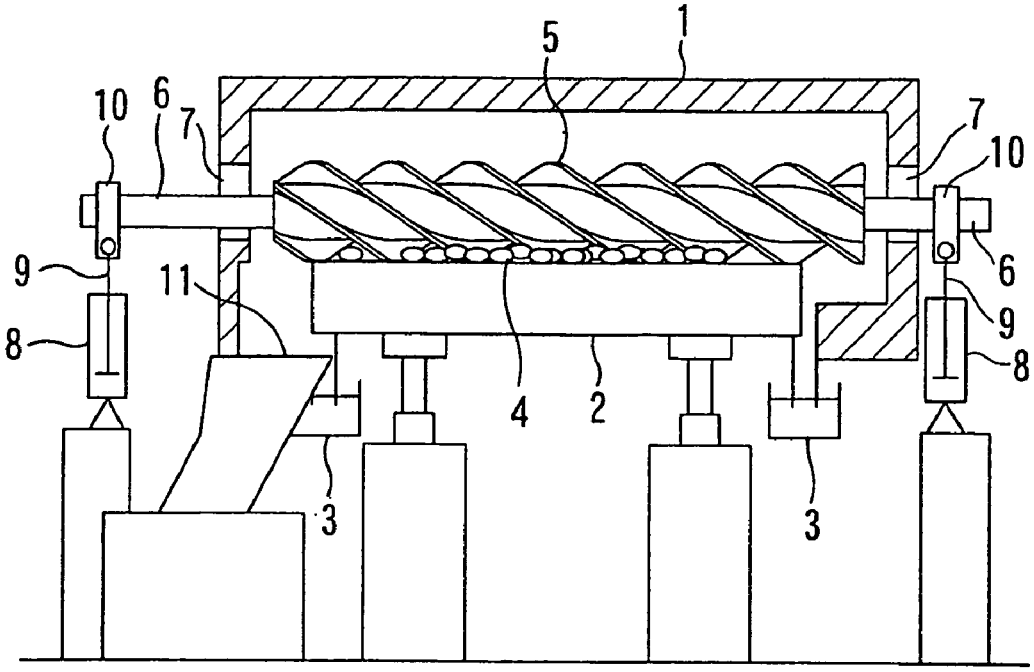
FIG. 1 is a schematic diagram showing an example of a rotary hearth furnace in which a screw conveyer according to the present invention is provided.

FIG. 1 is a schematic diagram showing an example of a rotary hearth furnace in which a reduced iron discharging screw conveyer according to the present invention (hereinafter referred to as "screw conveyer") is arranged.

A rotary hearth 2 is arranged on a lower side of a furnace casing 1 of the rotary hearth furnace and can rotate in a horizontal plane about its longitudinal axis. A water sealing process is performed between the furnace casing 1 and the rotary hearth 2 using a circular water sealing channel 3 for maintaining an atmosphere in the rotary hearth furnace.

A screw conveyer 5 is used for discharging a reduced iron pellet 4 obtained through a reduction processing of a pellet to an outside area. Both ends of a rotary shaft 6 pass through long holes 7 of the furnace casing 1 and are supported by a piston rod 9 of a cylinder 8 provided out of the furnace via a bearing 10 in a manner that the rotary shaft 6 can move up and down. The bearing 10 is fixed to the piston rod 9 and supported by the piston rod 9. A screw having a water-cooling structure in the rotary shaft 6 is used as the screw conveyer 5.

The reduced iron pellet 4 is moved toward an outer end of the rotary hearth 2 by a rotation of the screw conveyer 5 and drops from the outer end of the rotary hearth 2. Therefore the reduced iron pellet 4 is discharged out of the furnace through a discharge opening 11. It is desirable to always drive the screw conveyer 5 while cleaning the surface of the rotary hearth 2 in a manner that an end of the screw blade and the rotary hearth 2 steadily contact each other without providing a space between the end of the screw blade and the rotary hearth 2 by adjusting a position of the screw conveyer 5.

Figure 2:
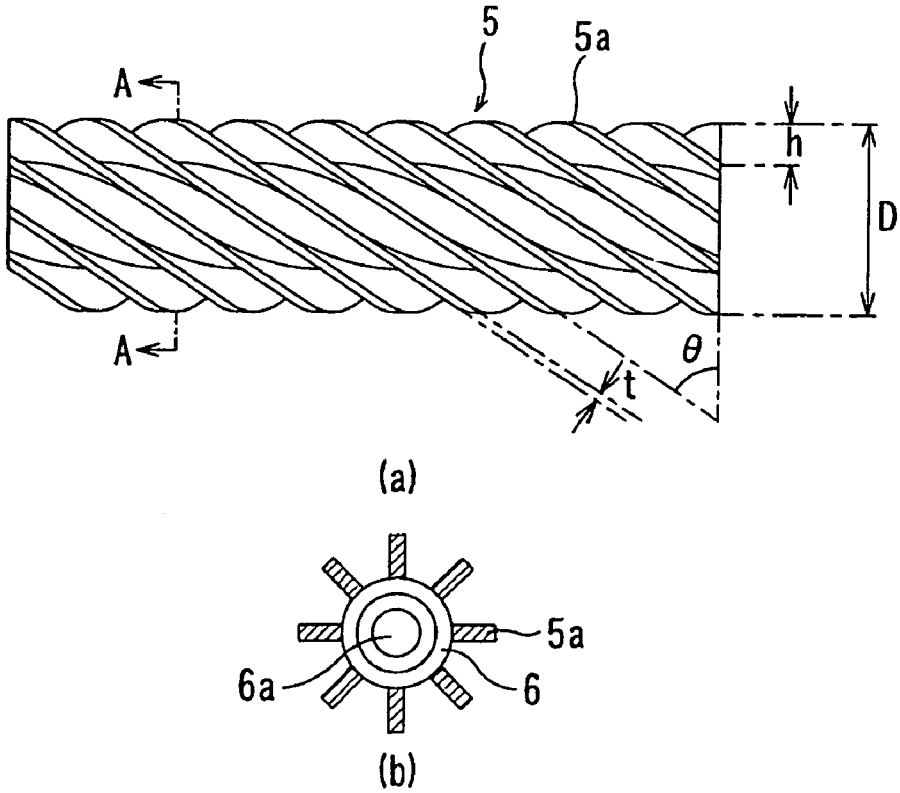
FIG. 2(*a*) is a front view showing the screw blade of the present invention, and (b) is cross sectional view along line A-A of a).

FIG. 2(*a*) is a front view showing a screw blade according to an embodiment of the present invention. FIG. 2(*b*) is a cross-section view of the screw blade along the line A-A of FIG. 2(*a*).

A cooling water channel 6*a* is formed in a hollow portion of the rotary shaft 6 and a screw blade 5*a* is spirally formed on the outer surface of the rotary shaft 6 via a welding processing.

It is possible to reduce the friction force between the screw blade 5*a* and the rotary hearth 2 by increasing the lead angle θ of the screw blade 5*a* and the number of threads of the screw blade 5*a*. As illustrated in FIG. 2(*a*), the lead angle θ is the angle between a line (or plane) that is perpendicular to the longitudinal axis of screw conveyor 5 and the screw blade 5*a*. Specifically the lead angle θ of the screw blade 5*a* is set so as to satisfy the following expression (1) in view of the friction and the scraping force described below.

$$0.46\text{rad} \leqq \theta \leqq 0.79\text{rad} \quad (1)$$

Figure 3:
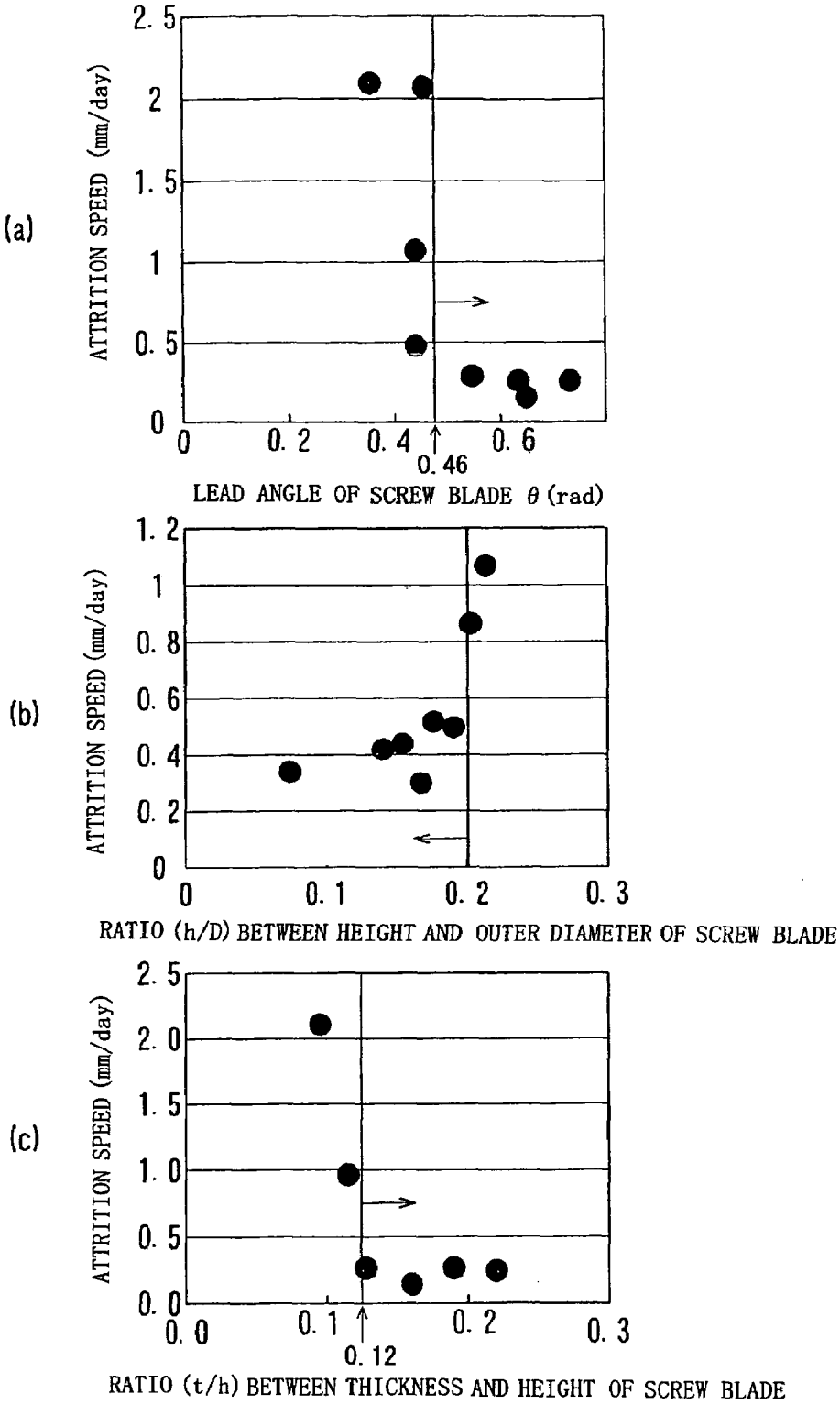
FIG. 3(*a*) is a graph showing a relationship between an attrition speed (mm/day) and a lead angle θ of the screw blade, (b) is a graph showing a relationship between the attrition speed (mm/day) and a ratio (h/D) between a height of the screw blade and an outer diameter of the screw conveyer, (c) is a graph showing a relationship between the attrition speed (mm/day) and a ratio (t/h) between a thickness and the height of the screw blade.
Figure 4:
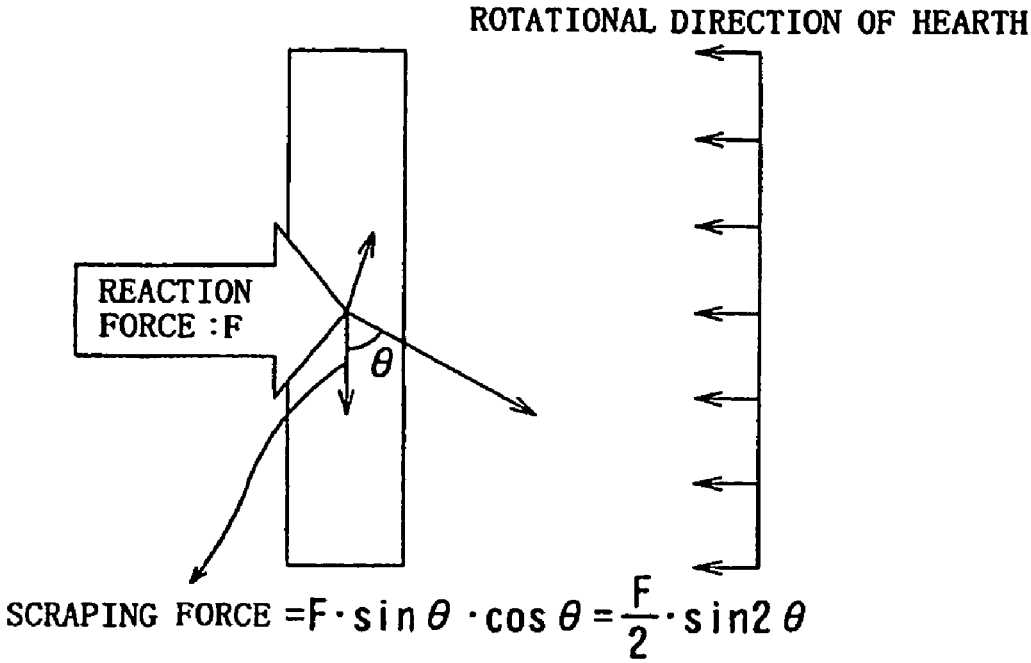
FIG. 4 A diagram illustrating a relationship between a scraping force and the lead angle θ of the screw blade.
Figure 5:
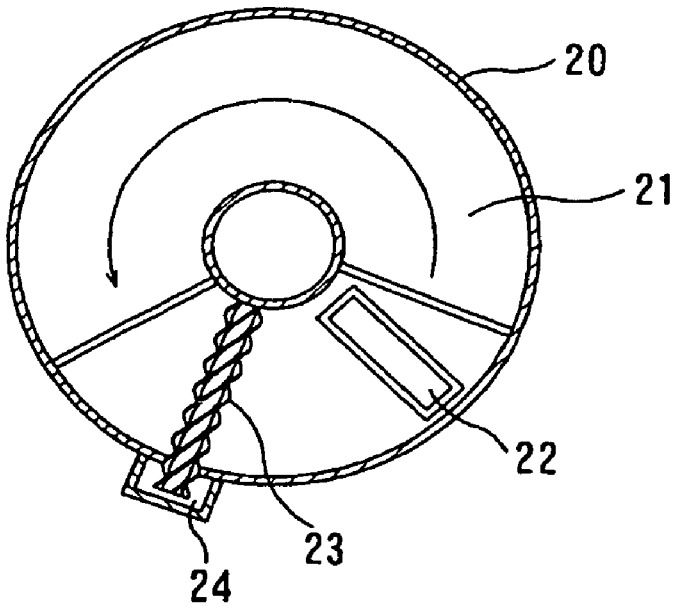
FIG. 5 PRIOR ART
FIG. 5 A schematic diaphragm showing an example of a rotary furnace used for producing reduced iron.

In FIG. 3, (a) is a graph showing a relationship between an attrition speed (mm/day) and the lead angle θ of the screw blade 5*a*, (b) is a graph showing a relationship between an attrition speed (mm/day) and ratio (h/D) between height of the screw blade 5*a* and outer diameter of the screw conveyer 5, and (c) is a graph showing a relationship between an attrition speed (mm/day) and a ratio between the thickness and the height of the screw blade 5*a*. FIG. 4 is a diagram for illustrating a relationship between the lead angle θ and the scraping force of the screw blade 5*a*.

The lower limit of the lead angle θ may be set so as to be larger than or equal to 0.46 rad since the experimental data in FIG. 3(*a*) shows that the attrition is increased as the attrition speed is increased when the lead angle θ of the screw blade 5*a* is lower than 0.46. In addition, since, as shown in FIG. 4, the scraping force of the screw blade 5*a* is represented by the expression "F*sin θ*cos θ=(F/2)sin 2θ", the scraping force becomes maximum when the lead angle θ is 0.79 rad (45 degree). On the other hand, if the lead angle θ of the screw blade 5*a* is larger than 0.79 rad, the scraping force of the screw blade 5*a* is decreased. Therefore the upper limit of the lead angle θ may be set to 0.79 rad.

When the number of threads of the screw blade 5*a* is increased and the lead angle θ becomes larger, the screw blade 5*a* is moved in a manner such that the screw blade 5*a* is inclined (near the horizontal plane) with respect to a moving direction of the rotary hearth 2. Therefore the frequency that sticks the deposit being on the rotary hearth 2 in a space between the end of the screw blade 5*a* and the rotary hearth 2 is decreased and then it is possible to reduce the attrition amount of the screw blade 5*a*. In addition, when the reduced iron remains and rolls toward the front of the screw conveyer 5 (one side) to be finely-divided, a part of the reduced iron becomes the deposit on the furnace. Herein since it is possible to improve the frequency scraping out the deposit on the rotary hearth 2 using the screw blade 5*a*, it is possible to reduce the deposit remaining on the rotary hearth 2 and hinder the deposit on the rotary hearth 2 from becoming hardened. In addition, when the lead angle θ of the screw blade 5*a* is set within the range of the expression (1), the scraping speed of the deposit is increased without increasing the revolutions of the screw conveyer 5 and the deposit remaining on the rotary hearth 2 is decreased.

In addition, since an end of the screw blade 5*a* that is furthermost from the rotary shaft 6 having the water cooling structure is less subject to receiving a water cooling effect, the attrition of the end is increased by contacting the rotary hearth 2 with a high temperature. In order to improve the water cooling effect of the screw blade 5*a*, a height h of screw blade 5*a* from the rotary shaft 6, a thickness t of the screw blade 5*a* and an outer diameter D of the screw conveyer 5 may be set within a range satisfying the following condition.

The influence on the attrition speed was examined while varying the ratio (h/D) between the height h of the screw blade 5*a* and the outer diameter D of the screw conveyer 5. In this case, as shown in FIG. 3(*b*), when the value h/D is equal or larger than 0.2, the attrition speed was drastically increased. In view of this result, the height h and the outer diameter D may be set so that the value h/D is smaller than 0.2.

Next, the influence on the attrition speed was examined while varying the ratio (t/h) between a thickness t of the screw blade 5*a* and a height h of the screw blade 5*a*. In this case, as shown in FIG. 3(*c*), the attrition speed was drastically decreased when the value t/h is larger than 0.12. In view of this result, the thickness t and the height h may be set so that the value t/h is equal to or larger than 0.12.

As described above, when the height h of the screw blade 5*a* is set so as not to exceed 20 percent with respect to the outer diameter D of the screw conveyer 5, and the thickness t of the screw blade 5*a* is set so as to exceed 12 percent with respect to the height h, the higher water cooling effect can be achieved and then it is possible to improve the attrition resistance. If the height h of the screw blade 5*a* is set so as not to exceed 20 percent with respect to the outer diameter D of the screw conveyer 5, it is difficult to manufacture the screw conveyer 5 in a conventional connection structure with bolts and nuts. Herein the screw conveyer 5 is easily manufactured if the screw blade 5*a* is welded to the rotary shaft 6.

Next the pressing force of the screw blade 5*a* applied to the rotary hearth 2 is explained in a case where the screw conveyer 5 described above is used. The attrition speed of the screw blade 5*a* was measured while varying a relationship between the lead angle θ of the screw blade 5*a* and the pressing force of the screw blade 5*a*. These results are shown in table 1.

TABLE 1

| | PRESSING FORCE OF SCREW BLADE [N/m] | LEAD ANGLE OF SCREW BLADE θ [rad] | ATTRITION SPEED [mm/day] |
|---|---|---|---|
| Example 1 | 19600 | 0.638 | 0.15 |
| Example 2 | 8400 | 0.622 | 0.25 |
| Example 3 | 23770 | 0.435 | 0.46 |
| Example 4 | 34780 | 0.54 | 0.27 |
| Example 5 | 18290 | 0.35 | 2.09 |
| Example 6 | 14700 | 0.448 | 2.07 |
| Example 7 | 18670 | 0.435 | 1.07 |
| Example 8 | 21000 | 0.72 | 0.25 |

As shown in table 1, examples 1, 2, 4 and 8 satisfying the condition of the expression (1) can reduce the attrition speed of the screw blade 5*a* in comparison with examples 3, 5-7 not satisfying the condition of the expression (1). In addition, regarding examples 4 and 8 in which the pressing force of the screw blade 5*a* exceeds 20000 N/m, it is possible to further reduce the attrition speed.

For this reason, it is desirable that the pressing force of the screw blade 5*a* applied to the rotary hearth 2 is larger than 20000 N/m. Applicants found in experiment and analysis that the attrition speed of the screw blade 5*a* can be decreased until the pressing force of the screw blade 5*a* reaches 35000 N/m. Therefore it is desirable that the upper limit of the pressing force of the screw blade 5*a* is 35000 N/m.

According to the screw conveyer of the present invention, it is possible to reduce the attrition amount of the screw blade 5*a* and operate the rotary hearth furnace for a long time even if the reduced iron deposited or attached on the rotary hearth is always scraped out and cleaned in a manner that the end of the screw blade 5*a* and the rotary hearth 2 are steadily in contact with each other without providing the space between the end of the screw blade 5*a* and the rotary hearth 2.

The invention claimed is:

1. A reduced iron discharging screw conveyer which is provided in a rotary hearth furnace and discharges reduced iron out of the rotary hearth furnace, the rotary hearth furnace producing the reduced iron by charging and heating a pellet including metallic oxide and coal material onto a rotary hearth rotating in a horizontal plane, the reduced iron discharging screw conveyer comprising:

a rotary shaft; and a screw blade which is spirally formed on an outer surface of the rotary shaft, wherein a lead angle θ of the screw blade satisfies a condition of the following expression (1), the lead angle θ being the angle between a line perpendicular to a longitudinal axis of the rotary shaft and the screw blade:

$$0.46\text{rad} \leqq \theta \leqq 0.79\text{rad} \quad (1).$$

2. The reduced iron discharging screw conveyer according to claim 1, wherein said rotary shaft and said screw blade are configured such that said screw blade is operable to apply a pressing force to the rotary furnace in an amount larger than 20000 N/m.

3. The reduced iron discharging screw conveyer according to claim 2, wherein said rotary shaft and said screw blade are configured such that said screw blade is operable to apply the pressing force to the rotary furnace in an amount smaller than 35000 N/m.

4. The reduced iron discharging screw conveyer according to claim 1, wherein a ratio between a height of the screw blade and an outer diameter of the screw conveyer satisfies a condition of the following expression (2); and wherein a ratio between thickness and height of the screw blade satisfies a condition of the following expression (3), $$h/D < 0.2 \quad (2)$$

$$t/h \geqq 0.12 \quad (3)$$

where h represents the height of the screw blade, D represents the outer diameter of the screw conveyer and t represents the thickness of the screw blade.

5. The reduced iron discharging screw conveyer according to claim 1, wherein an end of the screw blade contacts the rotary hearth.

6. The reduced iron discharging screw conveyer according to claim 1, further comprising:

a pair of bearings, each of the bearings being connected to a respective end of the rotary shaft; and a pair of cylinders, each of the cylinders being located at a respective end of the rotary shaft, each of the pair of cylinders including a piston rod fixed to and supporting a respective one of the bearings.

* * * * *